US008657704B2

(12) United States Patent
Ohama et al.

(10) Patent No.: US 8,657,704 B2
(45) Date of Patent: Feb. 25, 2014

(54) GOLF BALL

(75) Inventors: Keiji Ohama, Kobe (JP); Yoshiko Matsuyama, Kobe (JP); Toshiyuki Tarao, Kobe (JP); Kazuyoshi Shiga, Kobe (JP); Hirotaka Nakamura, Kobe (JP); Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 522 days.

(21) Appl. No.: 12/907,442

(22) Filed: Oct. 19, 2010

(65) Prior Publication Data

US 2011/0159999 A1 Jun. 30, 2011

(30) Foreign Application Priority Data

Dec. 28, 2009 (JP) ..... 2009-297584

(51) Int. Cl.
*A63B 37/06* (2006.01)

(52) U.S. Cl.
USPC ..... 473/371

(58) Field of Classification Search
USPC ..... 473/378–384, 371
See application file for complete search history.

(56) References Cited

U.S. PATENT DOCUMENTS

| | | | |
|---|---|---|---|
| 6,271,296 | B1 | 8/2001 | Nakamura et al. |
| 6,468,169 | B1 | 10/2002 | Hayashi et al. |
| 6,786,838 | B2 | 9/2004 | Sullivan et al. |
| 2001/0024982 | A1 | 9/2001 | Cavallaro et al. |
| 2003/0166422 | A1 | 9/2003 | Kato et al. |
| 2003/0211902 | A1 | 11/2003 | Kato et al. |
| 2004/0029648 | A1 | 2/2004 | Kato |
| 2004/0038753 | A1 | 2/2004 | Kato |
| 2009/0258731 | A1 | 10/2009 | Kamino et al. |

FOREIGN PATENT DOCUMENTS

| | | | |
|---|---|---|---|
| JP | 64-80377 | A | 3/1989 |
| JP | 2003-325702 | A | 11/2003 |
| JP | 2004-136075 | A | 5/2004 |
| JP | 2005-111246 | A | 4/2005 |
| JP | 2009-34518 | A | 2/2009 |
| JP | 2009-34519 | A | 2/2009 |
| JP | 2009-254471 | A | 11/2009 |

OTHER PUBLICATIONS

Japanese Office Action for Japanese Application No. 2009-297584, dated Jan. 10, 2012.
Japanese Office Action for Japanese Application No. 2009-297584 dated May 15, 2012.
Office Action dated May 14, 2013 for Japanese Application No. 2009-297584 with English Translation.

*Primary Examiner* — Raeann Gorden
(74) *Attorney, Agent, or Firm* — Birch, Stewart, Kolasch & Birch, LLP

(57) ABSTRACT

Golf ball wherein, at all points Pa included in zone "A" away from the central point of its core at a distance of ≥1 mm and <5 mm, this mathematical expression is satisfied: Ha2−Ha1<5, wherein Ha1 and Ha2 each represents hardness at a point located respectively inside a point Pa and outside the point Pa. Also, at any point Pb included in zone "B" away from the central point of its core at a distance of ≥5 mm and ≤10 mm, this mathematical expression is satisfied: Hb2−Hb1≥5, wherein Hb1 and Hb2 each represents hardness at a point located respectively inside a point Pb and outside the point Pb. This hardness distribution provides a golf ball with reduced energy loss when hit with a driver, and with excellent control performance when hit with a short iron.

17 Claims, 9 Drawing Sheets

GOLF BALL

This application claims priority on Patent Application No. 2009-297584 filed in JAPAN on Dec. 28, 2009. The entire contents of this Japanese Patent Application are hereby incorporated by reference.

BACKGROUND OF THE INVENTION

1. Field of the Invention

The present invention relates to golf balls. More particularly, the present invention relates to multi-piece golf balls having a core, a mid layer and a cover.

2. Description of the Related Art

Top requirement for golf balls by golf players is their flight performances. The golf players place great importance on flight performances achieved upon shots with a driver, a long iron and a middle iron. The flight performances correlate with resilience performances of the golf ball. Hitting of a golf ball that is excellent in resilience performance leads to a high-speed flight, whereby a great flight distance is attained.

For attaining a great flight distance, an appropriate trajectory height is required. The trajectory height varies depending on the spin rate and launch angle. Golf balls which achieve a high trajectory due to a high spin rate are accompanied by insufficient flight distance. Golf balls which achieve a high trajectory due to a great launch angle can attain a great flight distance. By employing a core having an outer-hard/inner-soft structure, a low spin rate and a great launch angle can be both achieved.

Golf players place great importance also on spin performances of golf balls. A great back spin rate results in small run. For golf players, golf balls which are liable to be spun backwards are apt to be rendered to stop at a target position. Great side spin rate results in easily curved trajectory of the golf ball. For golf players, golf balls which are liable to be spun sidewise are apt to allow their trajectory to curve intentionally. The golf balls that can be easily spun are excellent in control performances. High-level golf players particularly place great importance on control performances upon shots with a short iron.

In light of achievement of various performances, golf balls having a multilayer structure have been proposed. Japanese Unexamined Patent Application, Publication No. H10-328326 (equivalent to U.S. Pat. No. 6,468,169) discloses a golf ball having an inner sphere, an enclosure layer, an inner cover and an outer cover. Japanese Unexamined Patent Application, Publication No. 2001-17575 (equivalent to U.S. Pat. No. 6,271,296) discloses a golf ball having a core, an envelope layer, a mid layer and a cover. Japanese Unexamined Patent Application, Publication No. 2002-272880 (equivalent to US 2001/0024982) discloses a golf ball having a core and a cover. This core is composed of a center and an outer core layer. The cover is composed of an inner cover layer and an outer cover layer. Japanese Unexamined Patent Application, Publication No. 2003-205052 (equivalent to US 2003/0166422) discloses a golf ball having a center, a mid layer and a cover. Japanese Unexamined Patent Application, Publication No. 2004-130072 (equivalent to US 2004/0029648) discloses a golf ball having a core and a cover. This core has a three-layer structure.

When a core having an outer-hard/inner-soft structure and having an excessively large hardness distribution is hit with a driver, great energy loss occurs at this core. The energy loss results in deterioration of the resilience performance. When a core having an outer-hard/inner-soft structure and having an excessively large hardness distribution is hit with a short iron, a low spin rate is achieved. The low spin rate results in deterioration of the control performance.

An object of the present invention is to provide a golf ball that can attain a great flight distance upon hitting with a driver, and that is excellent in a control performance achieved upon hitting with a short iron.

SUMMARY OF THE INVENTION

A golf ball according to one aspect of the present invention has a core, a mid layer situated on the external side of the core, and a cover situated on the external side of the mid layer. The proportion of the volume of the core relative to the volume of the phantom sphere of the golf ball is no less than 76%. The JIS-C hardness Hc of the cover is less than the JIS-C hardness Ho of the central point of the core. At all points Pa included in zone "A" away from the central point of the core at a distance of 1 mm or greater and less than 5 mm, the following mathematical expression (I) is satisfied. At any point Pb included in zone "B" away from the central point of the core at a distance of 5 mm or greater and 10 mm or less, the following mathematical expression (II) is satisfied.

$$Ha2-Ha1<5 \quad \text{(I)}$$

$$Hb2-Hb1\geq 5 \quad \text{(II)}$$

In the above mathematical expression (I), Ha1 represents a JIS-C hardness at a point Pa1 that is located inside the point Pa along the radial direction and away from the point Pa at a distance of 1 mm, and Ha2 represents a JIS-C hardness at a point Pa2 that is located outside the point Pa along the radial direction and away from the point Pa at a distance of 1 mm. In the above mathematical expression (II), Hb1 represents a JIS-C hardness at a point Pb1 that is located inside the point Pb along the radial direction and away from the point Pb at a distance of 1 mm, and Hb2 represents a JIS-C hardness at a point Pb2 that is located outside the point Pb along the radial direction and away from the point Pb at a distance of 1 mm.

In the golf ball according to the present invention, the core has an appropriate hardness distribution. This core is accompanied by less energy loss upon hitting with a driver. According to this golf ball, a great flight distance is attained upon hitting with a driver. This golf ball is excellent in a control performance achieved upon hitting with a short iron.

Preferably, the JIS-C hardness Hc of the cover is no greater than 65. The cover has a thickness of preferably no greater than 0.8 mm.

Preferably, the JIS-C hardness Hm of the mid layer is no less than 90. The mid layer has a thickness of preferably no greater than 1.5 mm.

Preferably, a principal component of the base material of the cover is a thermoplastic polyurethane. The polyol component of this thermoplastic polyurethane is a polytetramethylene ether glycol having a number average molecular weight of no greater than 1,500.

Preferably, the difference between the JIS-C hardness He of the surface of the core and the hardness Hb2 is no less than 10. Preferably, the difference between the hardness He and the hardness Ho is no greater than 40.

Preferably, the difference between the hardness Ho and the hardness Hc is 3 or greater and 15 or less. preferably, the hardness Ho is 40 or greater and 80 or less. Preferably, the hardness He is 75 or greater and 95 or less. Preferably, the hardness Hm is greater than the hardness He.

The core may have a center and an envelope layer situated on the external side of the center. The center has a diameter of preferably 10 mm or greater and 20 mm or less. The envelope layer has a thickness of preferably 8 mm or greater and 18 mm or less. Preferably, the difference between the hardness He and the JIS-C hardness Hi of the innermost point of the envelope layer is 10 or greater and 25 or less. Preferably, the hardness He is greater than the JIS-C hardness of the surface of the center.

DESCRIPTION OF THE PREFERRED EMBODIMENTS

Hereinafter, the present invention will be described in detail according to the preferred embodiments with appropriate references to the accompanying drawing.

Figure 1:
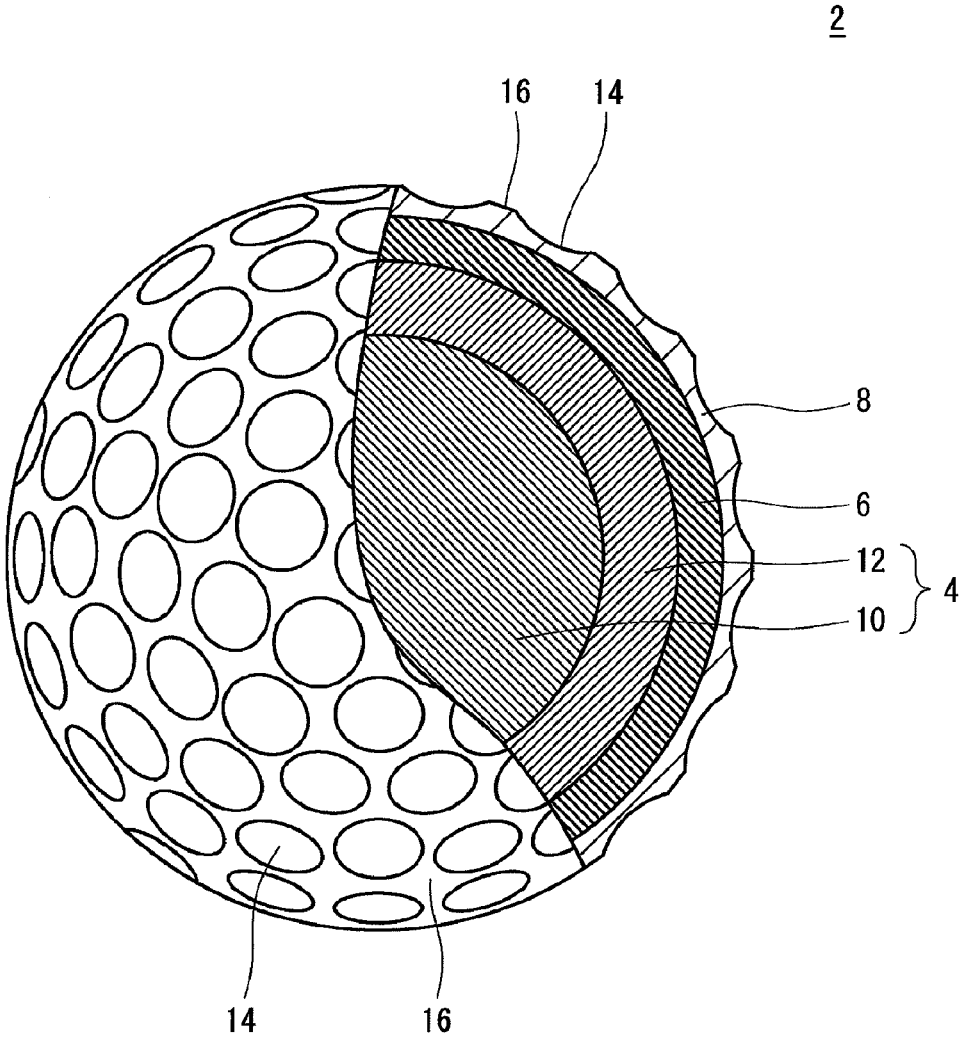
FIG. 1 shows a partially cut off cross-sectional view illustrating a golf ball according to one embodiment of the present invention.
Figure 2:
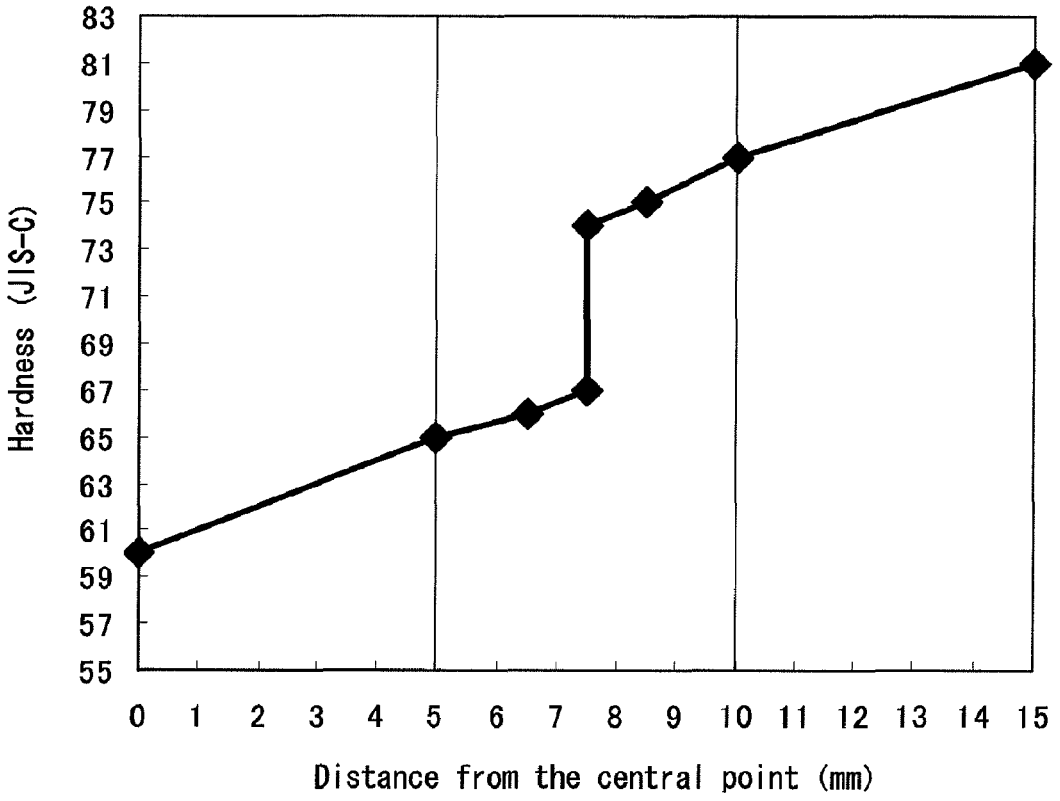
FIG. 2 shows a graph illustrating a hardness distribution of the core of a golf ball according to Example 1 of the present invention.
Figure 3:
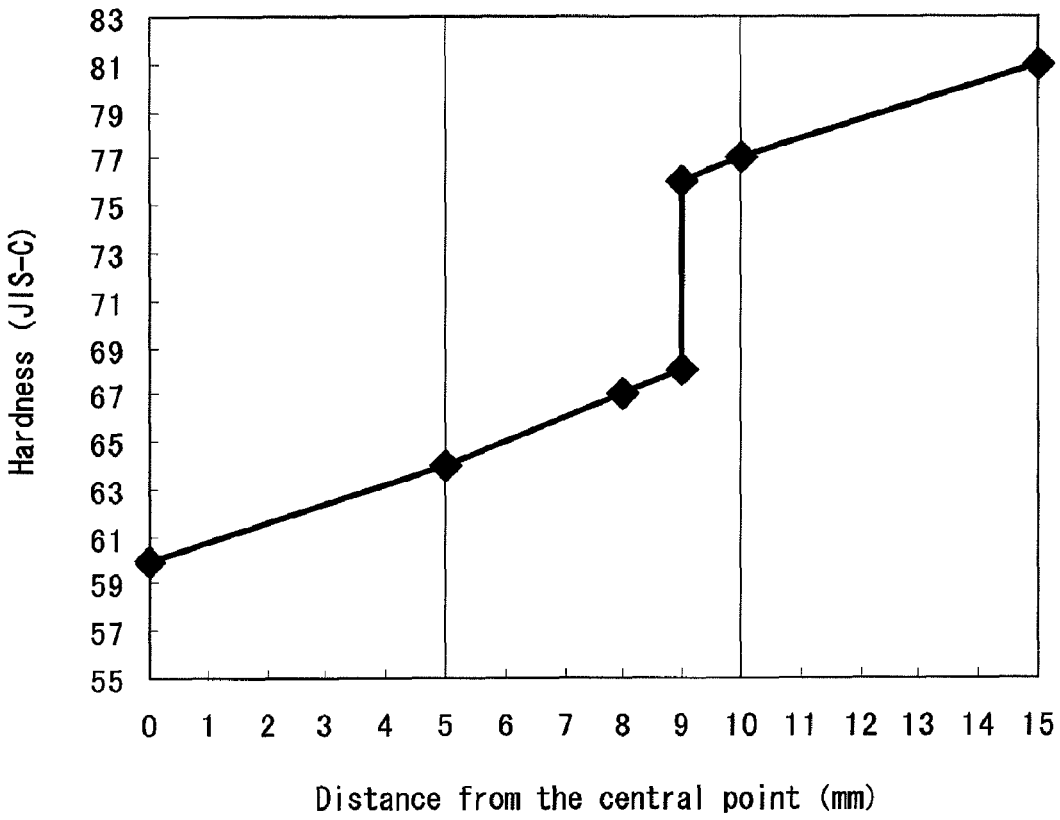
FIG. 3 shows a graph illustrating a hardness distribution of the core of a golf ball according to Example 2 of the present invention.
Figure 4:
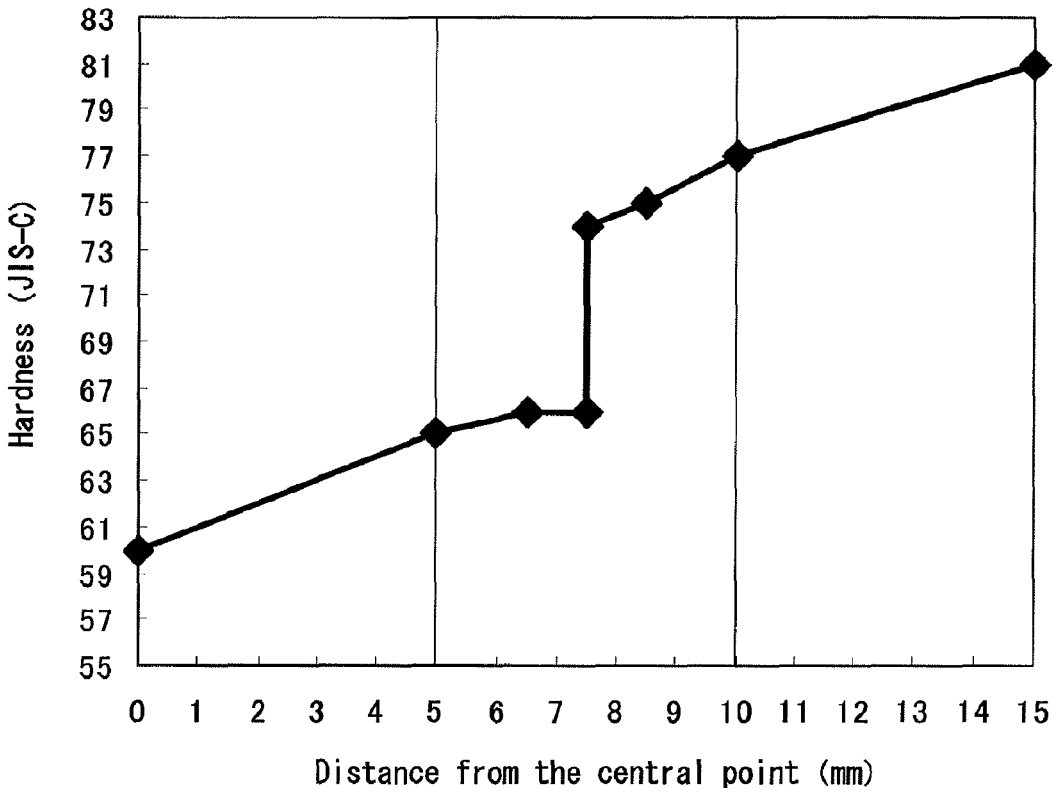
FIG. 4 shows a graph illustrating a hardness distribution of the core of a golf ball according to Example 3 of the present invention.
Figure 5:
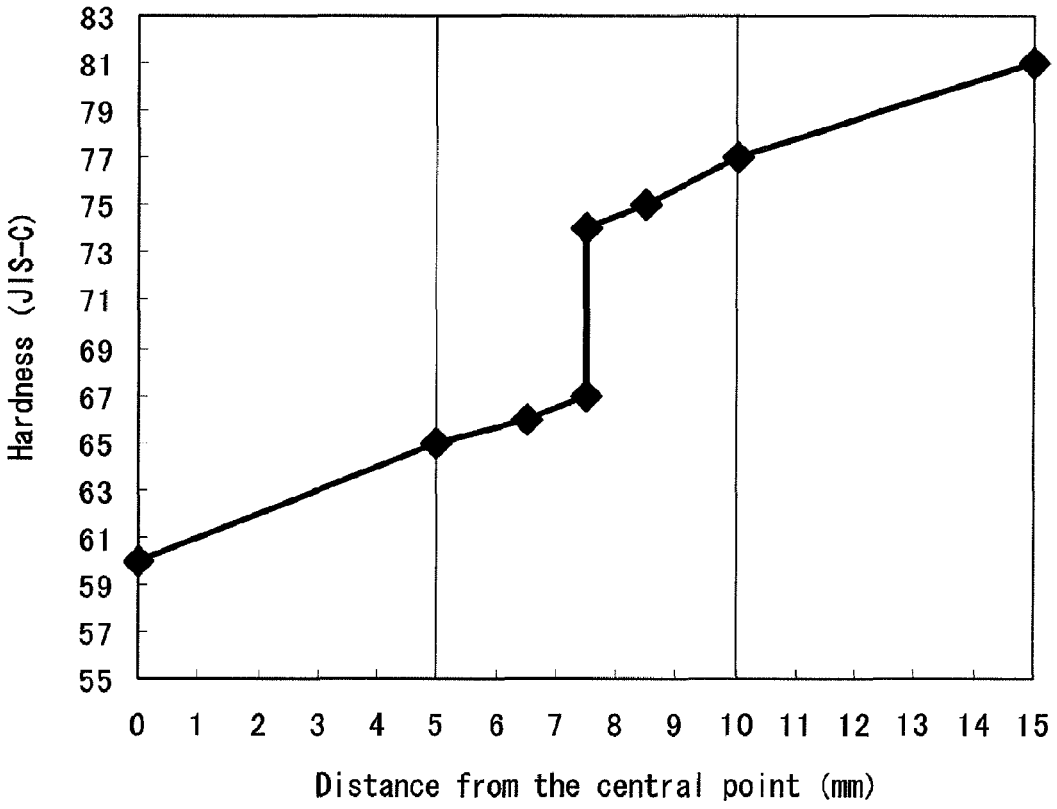
FIG. 5 shows a graph illustrating a hardness distribution of the core of a golf ball according to Example 4 of the present invention.
Figure 6:
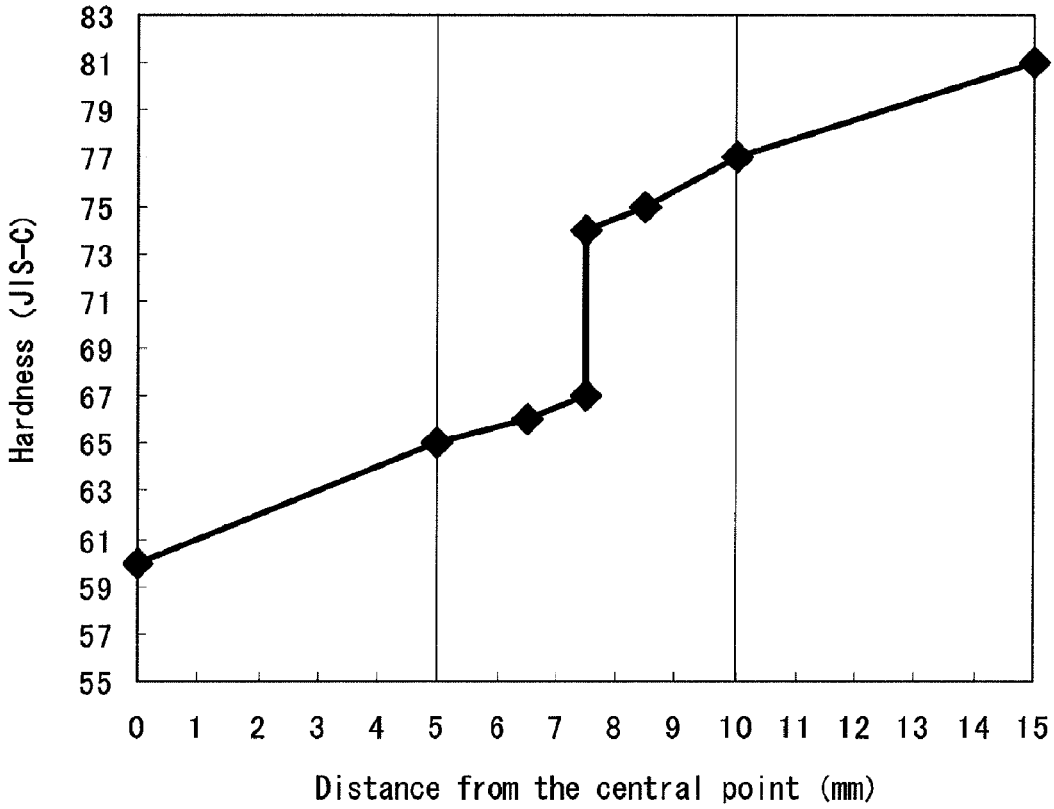
FIG. 6 shows a graph illustrating a hardness distribution of the cores of golf balls according to Examples 5 to 7 of the present invention and Comparative Example 1.
Figure 7:
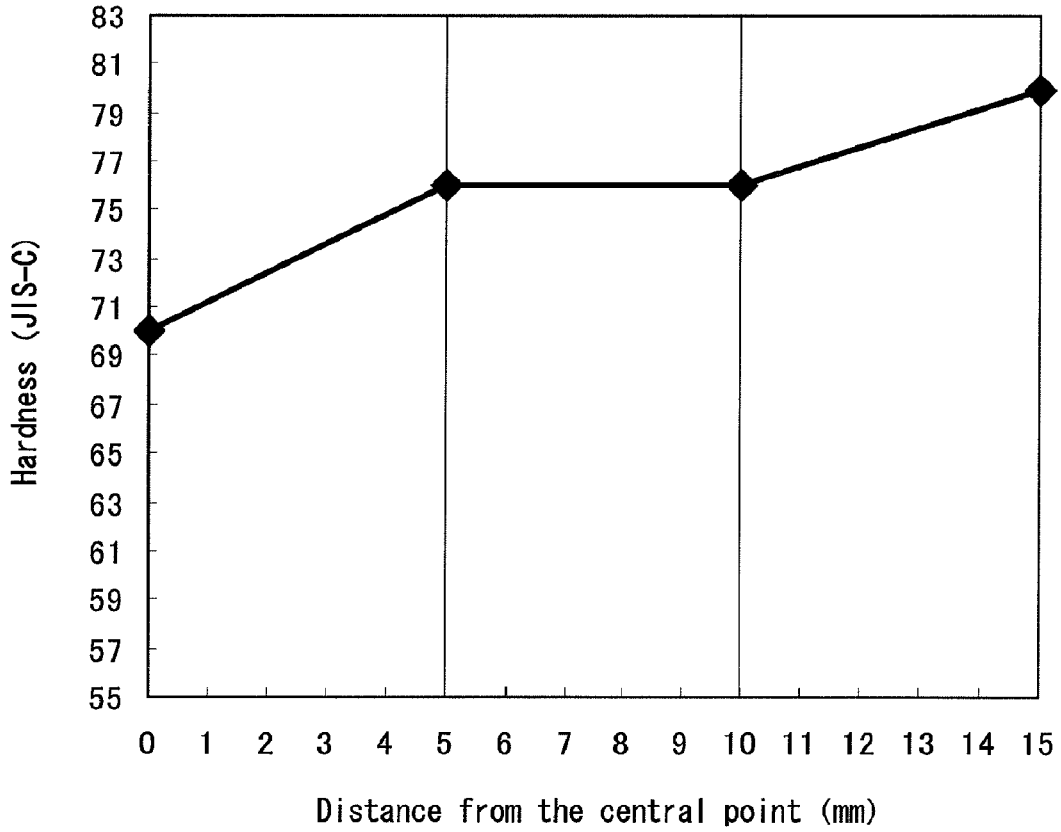
FIG. 7 shows a graph illustrating a hardness distribution of the core of a golf ball according to Comparative Example 2.
Figure 8:
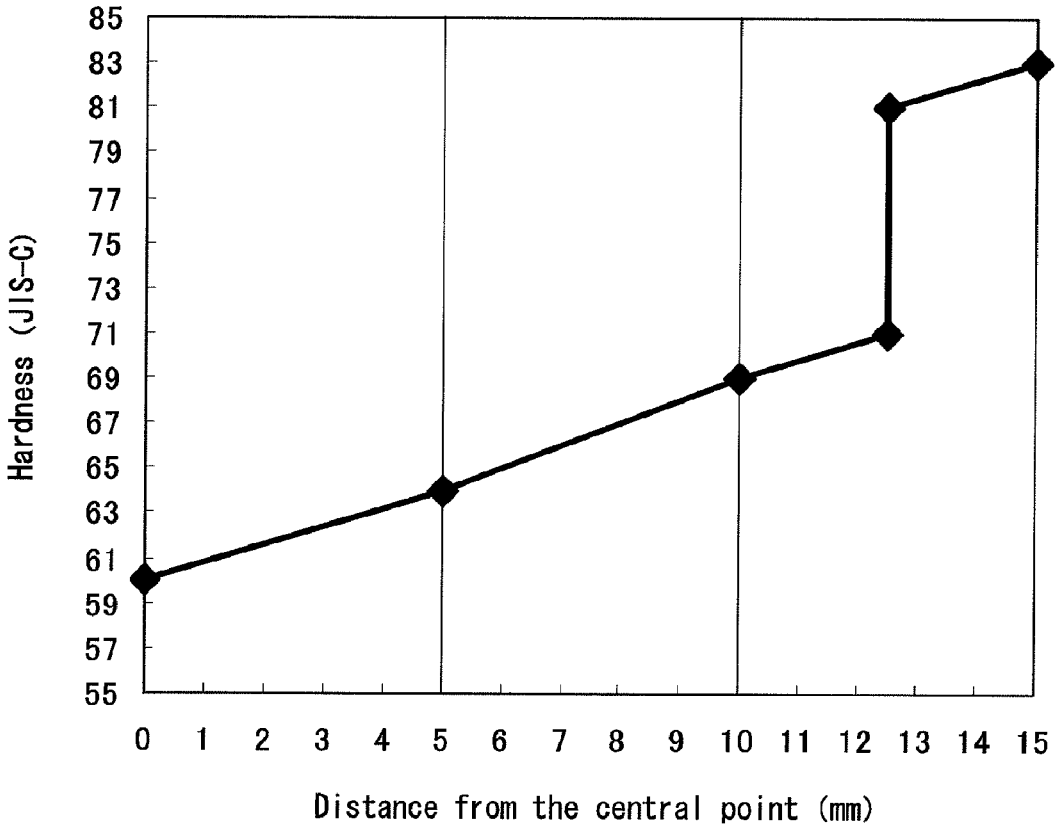
FIG. 8 shows a graph illustrating a hardness distribution of the core of a golf ball according to Comparative Example 3.
Figure 9:
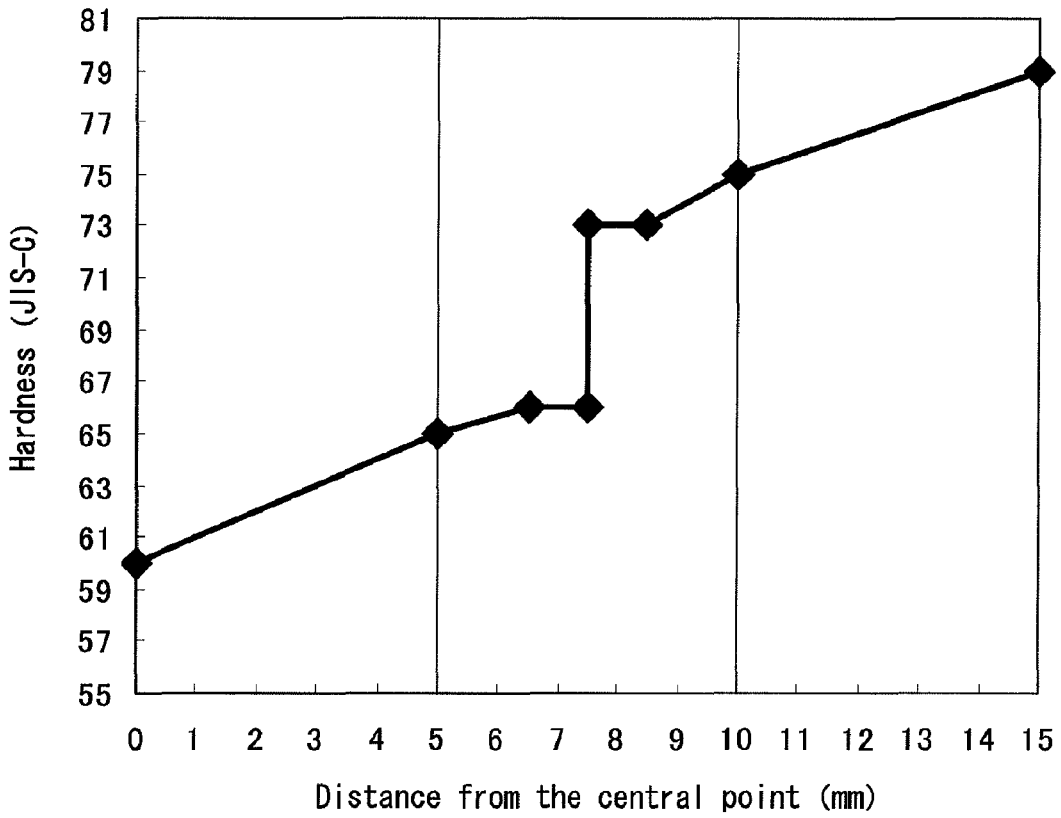
FIG. 9 shows a graph illustrating a hardness distribution of the core of a golf ball according to Comparative Example 4.

A golf ball 2 shown in FIG. 1 has a spherical core 4, a mid layer 6 situated on the external side of the core 4, and a cover 8 situated on the external side of the mid layer 6. The core 4 has a spherical center 10, and an envelope layer 12 situated on the external side of the center 10. A large number of dimples 14 are formed on the surface of the cover 8. Of the surface of the golf ball 2, a part other than the dimples 14 is land 16. This golf ball 2 has a paint layer and a mark layer on the external side of the cover 8 although these layers are not shown in the Figure.

This golf ball 2 has a diameter of from 40 mm to 45 mm. From the standpoint of conformity to a rule defined by the United States Golf Association (USGA), the diameter is preferably no less than 42.67 mm. In light of suppression of the air resistance, the diameter is preferably no greater than 44 mm, and more preferably no greater than 42.80 mm. The weight of this golf ball 2 is 40 g or greater and 50 g or less. In light of attainment of great inertia, the weight is preferably no less than 44 g, and more preferably no less than 45.00 g. From the standpoint of conformity to a rule defined by the USGA, the weight is preferably no greater than 45.93 g.

Preferably, the center 10 is obtained through crosslinking of a rubber composition. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with a polybutadiene, it is preferred that the polybutadiene is included as a principal component. Specifically, the percentage of the amount of the polybutadiene relative to the total amount of the base rubber is preferably no less than 50% by weight, and more preferably no less than 80% by weight. The percentage of cis-1,4 bonds in the polybutadiene is preferably no less than 40%, and more preferably no less than 80%.

The rubber composition for use in the center 10 contains a co-crosslinking agent. The co-crosslinking agent serves in achieving a high resilience of the center 10. Preferable examples of the co-crosslinking agent in light of the resilience performance include monovalent or bivalent metal salts of an $\alpha,\beta$-unsaturated carboxylic acid having 2 to 8 carbon atoms. Specific examples of the preferable co-crosslinking agent include zinc acrylate, magnesium acrylate, zinc methacrylate and magnesium methacrylate. In light of the resilience performance, zinc acrylate and zinc methacrylate are particularly preferred.

In light of the resilience performance of the golf ball 2, the amount of the co-crosslinking agent is preferably no less than 10 parts by weight, and more preferably no less than 15 parts by weight relative to 100 parts by weight of the base rubber. In light of soft feel at impact, the amount of the co-crosslinking agent is preferably no greater than 50 parts by weight, and more preferably no greater than 45 parts by weight relative to 100 parts by weight of the base rubber.

Preferably, the rubber composition for use in the center 10 includes an organic peroxide together with the co-crosslinking agent. The organic peroxide serves as a crosslinking initiator. The organic peroxide is responsible for the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of versatility, dicumyl peroxide is preferred.

In light of the resilience performance of the golf ball 2, the amount of the organic peroxide is preferably no less than 0.1 part by weight, more preferably no less than 0.3 part by weight, and particularly preferably no less than 0.5 part by weight relative to 100 parts by weight of the base rubber. In light of soft feel at impact, the amount of the organic peroxide is preferably no greater than 3.0 parts by weight, more preferably no greater than 2.8 parts by weight, and particularly preferably no greater than 2.5 parts by weight relative to 100 parts by weight of the base rubber.

Preferably, the rubber composition for use in the center 10 contains an organic sulfur compound. Illustrative examples of preferable organic sulfur compound include mono-substituted forms such as diphenyl disulfide, bis(4-chlorophenyl) disulfide, bis(3-chlorophenyl) disulfide, bis(4-bromophenyl) disulfide, bis(3-bromophenyl) disulfide, bis(4-fluorophenyl) disulfide, bis(4-iodophenyl) disulfide and bis(4-cyanophenyl) disulfide; di-substituted forms such as bis(2,5-dichlorophenyl) disulfide, bis(3,5-dichlorophenyl) disulfide, bis(2,6-dichlorophenyl) disulfide, bis(2,5-dibromophenyl) disulfide, bis(3,5-dibromophenyl) disulfide, bis(2-chloro-5-bromophenyl) disulfide and bis(2-cyano-5-bromophenyl) disulfide; tri-substituted forms such as bis(2,4,6-trichlorophenyl) disulfide and bis(2-cyano-4-chloro-6-bromophenyl) disulfide; tetra-substituted forms such as bis(2,3,5,6-tetrachlorophenyl) disulfide; and penta-substituted forms such as bis(2,3,4,5,6-pentachlorophenyl)disulfide and bis(2,3,4,5,6-pentabromophenyl)disulfide. The organic sulfur compound is responsible for the resilience performance. Particularly preferred organic sulfur compounds are diphenyl disulfide, and bis(pentabromophenyl) disulfide.

In light of the resilience performance of the golf ball 2, the amount of the organic sulfur compound is preferably no less than 0.1 part by weight, and more preferably no less than 0.2 part by weight relative to 100 parts by weight of the base rubber. In light of soft feel at impact, the amount of the organic sulfur compound is preferably no greater than 1.5 parts by weight, more preferably no greater than 1.0 part by weight, and particularly preferably no greater than 0.8 part by weight relative to 100 parts by weight of the base rubber.

Into the center 10 may be blended a filler for the purpose of adjusting the specific gravity and the like. Illustrative examples of suitable filler include zinc oxide, barium sulfate, calcium carbonate and magnesium carbonate. The amount of the filler is determined ad libitum so that the intended specific gravity of the center 10 can be accomplished. Particularly preferable filler is zinc oxide. Zinc oxide serves not only to adjust the specific gravity but also as a crosslinking activator.

An anti-aging agent, a coloring agent, a plasticizer, a dispersant, sulfur, a vulcanization accelerator and the like may be added to the rubber composition for use in the center 10 as needed. In this rubber composition may be also dispersed crosslinked rubber powders or synthetic resin powders.

In light of the resilience performance, the central hardness Ho of the center 10 is preferably no less than 40, more preferably no less than 45, and particularly preferably no less than 50. In light of suppression of the spin, the central hardness H1 is preferably no greater than 80, more preferably no greater than 75, and particularly preferably no greater than 70. The central hardness Ho is measured by pushing a JIS-C type hardness scale on a central point of a section of a hemisphere which had been obtained by cutting the center 10. For the measurement, an automated rubber hardness tester ("P1", trade name, available from Kobunshi Keiki Co., Ltd.) equipped with this hardness scale is used.

The hardness of this center 10 gradually increases from the central point toward the surface. The surface hardness of the center 10 is greater than the central hardness Ho.

The center 10 has a diameter of 10 mm or greater and 20 mm or less. By the center 10 having a diameter of no less than 10 mm, excellent feel at impact can be achieved. In this respect, the diameter is more preferably no less than 12 mm, and particularly preferably no less than 13 mm. The center 10 having a diameter of no greater than 20 mm enables the envelope layer 12 having a sufficiently great thickness can be formed. In this respect, the diameter is more preferably no greater than 18 mm, and particularly preferably no greater than 17 mm.

The envelope layer 12 is obtained through crosslinking of a rubber composition. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with a polybutadiene, it is preferred that the polybutadiene is included as a principal component. Specifically, the percentage of the amount of the polybutadiene relative to the total amount of the base rubber is preferably no less than 50% by weight, and more preferably no less than 80% by weight. The percentage of cis-1,4 bonds in the polybutadiene is preferably no less than 40%, and more preferably no less than 80%.

A co-crosslinking agent is preferably used in crosslinking the envelope layer 12. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. In light of the resilience performance, zinc acrylate and zinc methacrylate are particularly preferred.

In light of the resilience performance of the golf ball 2, the amount of the co-crosslinking agent is preferably no less than 20 parts by weight, more preferably no less than 25 parts by weight, and particularly preferably no less than 30 parts by weight relative to 100 parts by weight of the base rubber. In light of soft feel at impact, the amount of the co-crosslinking agent is preferably no greater than 60 parts by weight, more preferably no greater than 55 parts by weight, and particularly preferably no greater than 50 parts by weight relative to 100 parts by weight of the base rubber.

Preferably, the rubber composition for use in the envelope layer 12 includes an organic peroxide together with the co-crosslinking agent. The organic peroxide serves as a crosslinking initiator. The organic peroxide is responsible for the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of versatility, dicumyl peroxide is preferred.

In light of the resilience performance of the golf ball 2, the amount of the organic peroxide is preferably no less than 0.1 part by weight, more preferably no less than 0.3 part by weight, and particularly preferably no less than 0.5 part by weight relative to 100 parts by weight of the base rubber. In light of soft feel at impact, the amount of the organic peroxide is preferably no greater than 3.0 parts by weight, more preferably no greater than 2.8 parts by weight, and particularly preferably no greater than 2.5 parts by weight relative to 100 parts by weight of the base rubber.

Preferably, the rubber composition for use in the envelope layer 12 contains an organic sulfur compound. The organic sulfur compound described above in connection with the center 10 can be used for the envelope layer 12. In light of the resilience performance of the golf ball 2, the amount of the organic sulfur compound is preferably no less than 0.1 part by weight, and more preferably no less than 0.2 part by weight relative to 100 parts by weight of the base rubber. In light of soft feel at impact, the amount of the organic sulfur compound is preferably no greater than 1.5 parts by weight, more preferably no greater than 1.0 part by weight, and particularly preferably no greater than 0.8 part by weight relative to 100 parts by weight of the base rubber.

Into the envelope layer 12 may be blended a filler for the purpose of adjusting the specific gravity and the like. Illustrative examples of suitable filler include zinc oxide, barium sulfate, calcium carbonate and magnesium carbonate. Powders constituted with a highly dense metal may be also blended as the filler. Specific examples of the highly dense metal include tungsten and molybdenum. The amount of the filler is determined ad libitum so that the intended specific gravity of the envelope layer 12 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount in the envelope layer as needed. Into the envelope layer 12 may be also blended crosslinked rubber powders or synthetic resin powders.

In the molding of the envelope layer 12, the center 10 is covered by two pieces of uncrosslinked or partially crosslinked half shell. The half shells are compressed and heated. The heating causes a crosslinking reaction, thereby completing an envelope layer 12. The crosslinking temperature is usually 140° C. or higher and 180° C. or lower. The crosslinking time period of the envelope layer 12 is usually 10 minutes or longer and 60 minutes or shorter.

In this envelope layer 12, the hardness gradually increases from the innermost point toward the surface. In light of the resilience performance, the hardness He of the surface of the envelope layer 12 (i.e., the surface of the core 4) is preferably no less than 75, more preferably no less than 80, and particularly preferably no less than 85. In light of the feel at impact, the hardness He is preferably no greater than 95, more preferably no greater than 93, and particularly preferably no greater than 92. The hardness He is measured by pushing a JIS-C type hardness scale on the surface of the core 4. For the measurement, an automated rubber hardness tester ("P1", trade name, available from Kobunshi Keiki Co., Ltd.) equipped with this hardness scale is used.

In light of suppression of the spin, the difference (He−Hi) between the surface hardness He of the envelope layer 12 and the hardness Hi of the innermost point of the envelope layer 12 is preferably no less than 10, more preferably no less than 12, and particularly preferably no less than 15. In light of ease in manufacture and durability, the difference (He−Hi) is preferably no greater than 25.

The hardness Hi is measured on a hemisphere obtained by cutting the core 4. By pushing a JIS-C type hardness scale on a section of the hemisphere, the hardness Hi is measured. The hardness scale is pushed on a region sandwiched between a first circle and a second circle. The first circle corresponds to a boundary between the center and the envelope layer 12. The second circle is concentric with the first circle and has a radius greater than the first circle by 1 mm. For the measurement, an automated rubber hardness tester ("P1", trade name, available from Kobunshi Keiki Co., Ltd.) equipped with this hardness scale is used.

The envelope layer 12 has a thickness of preferably 8 mm or greater and 18 mm or less. The envelope layer 12 having a thickness of no less than 8 mm can suppress the spin. In this respect, the thickness is more preferably no less than 9 mm, and particularly preferably no less than 10 mm. The envelope layer 12 having a thickness of no greater than 18 mm enables the center 10 having a large diameter to be formed. The center 10 having a large diameter can suppress the spin. In this respect, the thickness is more preferably no greater than 16 mm, and particularly preferably no greater than 15 mm.

In light of suppression of the spin, the difference (He−Ho) between the surface hardness He of the core 4 and the central hardness Ho of the center 10 is preferably no less than 20, and particularly preferably no less than 25. In light of the resilience performance of the core 4, the difference (He−Ho) is preferably no greater than 40, and particularly preferably no greater than 35.

Herein, a zone away from the central point of the core 4 at a distance of 1 mm or greater and less than 5 mm is referred to as "zone A", whereas a zone away from the central point of core 4 at a distance of 5 mm or greater and 10 mm or less is referred to as "zone B".

At all points Pa included in the zone A, the following mathematical expression (I) is satisfied.

$$Ha2-Ha1<5 \quad \text{(I)}$$

In this mathematical expression (I), Ha1 represents the JIS-C hardness of the point Pa1. The point Pa1 is located inside the point Pa along the radial direction. The point Pa1 is away from the point Pa at a distance of 1 mm. In this mathematical expression (I), Ha2 represents the JIS-C hardness of the point Pa2. The point Pa2 is located outside the point Pa along the radial direction. The point Pa2 is away from the point Pa at a distance of 1 mm. The hardness Ha1 and the hardness Ha2 are measured by pushing a JIS-C type hardness scale on a section of the hemisphere, which had been obtained by cutting the center 10. For the measurement, an automated rubber hardness tester ("P1", trade name, available from Kobunshi Keiki Co., Ltd.) equipped with this hardness scale is used.

The core 4 that satisfies the above mathematical expression (I) is accompanied by less energy loss upon hitting with a golf club. This core 4 can serve in achieving a high resilience of the golf ball 2. The golf ball 2 having this core 4 is excellent in the flight performance. In light of the flight performance, the difference (Ha2−Ha1) is more preferably no greater than 4, and particularly preferably no greater than 3. The difference (Ha2−Ha1) may be zero.

At any point Pb included in the zone B, the following mathematical expression (II) is satisfied.

$$Hb2-Hb1\geq 5 \quad \text{(II)}$$

In this mathematical expression (II), Hb1 represents the JIS-C hardness of the point Pb1. The point Pb1 is located inside the point Pb along the radial direction. The point Pb1 is away from the point Pb at a distance of 1 mm. In this mathematical expression (II), Hb2 represents the JIS-C hardness of the point Pb2. The point Pb2 is located outside the point Pb along the radial direction. The point Pb2 is away from the point Pb at a distance of 1 mm. The hardness Hb1 and the hardness Hb2 are measured by pushing a JIS-C type hardness scale on a section of the hemisphere, which had been obtained by cutting the center 10. For the measurement, an automated rubber hardness tester ("P1", trade name, available from Kobunshi Keiki Co., Ltd.) equipped with this hardness scale is used.

The core 4 that satisfies the above mathematical expression (II) suppresses the spin of the golf ball 2. In this respect, the difference (Hb2−Hb1) is particularly preferably no less than 7. In light of less energy loss upon hitting with a golf club, the difference (Hb2−Hb1) is preferably no greater than 20, and particularly preferably no greater than 15.

The proportion of the volume of the core 4 relative to the volume of the phantom sphere of the golf ball 2 is no less than 76%. In other words, this core 4 is large. This core 4 can serve in achieving a superior resilience performance of the golf ball 2. This core 4 can suppress the spin of the golf ball 2. In these respects, this proportion is more preferably no less than 78%, and particularly preferably no less than 80%. The surface of the phantom sphere corresponds to the surface of the golf ball 2 assumed as not having the dimples 14.

In light of suppression of the spin, the difference (He−Hb2) between the surface hardness He of the core 4 and the hardness Hb2 is preferably no less than 10, and particularly preferably no less than 12. In light of less energy loss, the difference (He−Hb2) is preferably no greater than 20.

For the mid layer 6, a resin composition may be suitably used. Illustrative examples of the base polymer of this resin composition include ionomer resins, styrene block-containing thermoplastic elastomers, thermoplastic polyester elastomers, thermoplastic polyamide elastomers and thermoplastic polyolefin elastomers.

Particularly preferable base polymer is an ionomer resin. The ionomer resins are highly elastic. As described later, this golf ball 2 has a thin and soft cover 8. Therefore, upon hitting of this golf ball 2 with a driver, the mid layer 6 is greatly deformed. The mid layer 6 containing the ionomer resin is responsible for the resilience performance achieved upon shots with a driver. An ionomer resin and other resin may be used in combination. When these are used in combination, the percentage of the amount of the ionomer resin relative to the total amount of the base polymer is preferably no less than 50% by weight, more preferably no less than 70% by weight, and particularly preferably no less than 85% by weight, in light of the resilience performance.

Examples of preferred ionomer resin include binary copolymers formed with an α-olefin and an α,β-unsaturated carboxylic acid having 3 to 8 carbon atoms. Preferable binary copolymer comprises a 80% by weight or more and 90% by weight or less α-olefin, and a 10% by weight or more and 20% by weight or less α,β-unsaturated carboxylic acid. This binary copolymer provides excellent resilience performance. Examples of other ionomer resin preferred include ternary copolymers formed with an α-olefin, an α,β-unsaturated carboxylic acid having 3 to 8 carbon atoms, and an α,β-unsaturated carboxylate ester having 2 to 22 carbon atoms. Preferable ternary copolymer comprises a 70% by weight or more and 85% by weight or less α-olefin, a 5% by weight or more and 30% by weight or less α,β-unsaturated carboxylic acid, and a 1% by weight or more and 25% by weight or less α,β-unsaturated carboxylate ester. This ternary copolymer provides excellent resilience performance. In the binary copolymer and ternary copolymer, preferable α-olefin is ethylene and propylene, and preferable α,β-unsaturated carboxylic acid is acrylic acid and methacrylic acid. Particularly preferred ionomer resin is a copolymer formed with ethylene, and acrylic acid or methacrylic acid.

In the binary copolymer and ternary copolymer, a part of the carboxyl groups may be neutralized with a metal ion. Illustrative examples of the metal ion for use in the neutralization include sodium ion, potassium ion, lithium ion, zinc ion, calcium ion, magnesium ion, aluminum ion and neodymium ion. The neutralization may be carried out with two or more kinds of the metal ions. Particularly suitable metal ion in light of the resilience performance and durability of the golf ball 2 is sodium ion, zinc ion, lithium ion and magnesium ion.

Specific examples of the ionomer resin include "Himilan® 1555", "Himilan® 1557", "Himilan® 1605", "Himilan® 1706", "Himilan® 1707", "Himilan® 1856", "Himilan® 1855", "Himilan® AM7311", "Himilan® AM7315", "Himilan® AM7317", "Himilan® AM7318", "Himilan AM7329", "Himilan® MK7320" and "Himilan® MK7329", trade names, available from Du Pont-MITSUI POLYCHEMICALS Co., Ltd.; "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945", "Surlyn® AD8546", "HPF 1000" and "HPF 2000", trade names, available from Du Pont Kabushiki Kaisha; and "IOTEK 7010", "IOTEK 7030", "IOTEK 7510", "IOTEK 7520", "IOTEK 8000" and "IOTEK 8030", trade names, available from EXXON Mobil Chemical Corporation.

Two or more kinds of the ionomer resins may be used in combination in the mid layer 6. An ionomer resin neutralized with a monovalent metal ion and an ionomer resin neutralized with a bivalent metal ion may be used in combination.

The mid layer 6 may also contain a highly elastic resin. Illustrative examples of the highly elastic resin include polybutylene terephthalate, polyphenylene ether, polyethylene terephthalate, polysulfone, polyether sulfone, polyphenylene sulfide, polyarylate, polyamideimide, polyether imide, polyether ether ketone, polyimide, polytetrafluoroethylene, polyaminobismaleimide, polybisamide triazole, polyphenyleneoxide, polyacetal, polycarbonate, acrylonitrile-butadiene-styrene copolymers and acrylonitrile-styrene copolymers.

Into the mid layer 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. For forming the mid layer 6, a known procedure such as injection molding, compression molding and the like may be employed.

The mid layer 6 has the hardness Hm of preferably no less than 90. The mid layer 6 having the hardness Hm of no less than 90 can serve in achieving excellent resilience performance of the golf ball 2. In addition, with the mid layer 6 having the hardness Hm of no less than 90, an outer-hard/inner-soft structure of a sphere composed of the core 4 and the mid layer 6 can be attained. The sphere having an outer-hard/inner-soft structure suppresses the spin of the golf ball 2. In these respects, the hardness Hm is particularly preferably no less than 92. In light of the feel at impact, the hardness Hm is preferably no greater than 98, and particularly preferably no greater than 97. In light of suppression of the spin, it is preferred that the hardness Hm of the mid layer 6 is greater than the surface hardness He of the core 4, and that the surface hardness He of the core 4 is greater than the surface hardness of the center 10.

The hardness Hm is measured with a JIS-C type spring hardness scale attached to an Auto Loading Durometer (automated rubber hardness tester, Kobunshi Keiki Co., Ltd., trade name "P1"). For the measurement, a slab formed by hot press is used. The slab has a thickness of about 2 mm. The slab which had been stored at a temperature of 23° C. for two weeks is used for the measurement. When the measurement is carried out, three slabs are overlaid. The slab constituted with the same resin composition as that of the mid layer 6 is used for the measurement.

In light of suppression of the spin, the thickness of the mid layer 6 is preferably no less than 0.3 mm, more preferably no less than 0.5 mm, and particularly preferably no less than 0.6 mm. In light of the feel at impact, the thickness is preferably no greater than 1.5 mm, more preferably no greater than 1.2 mm, and particularly preferably no greater than 1.0 mm.

The cover 8 is constituted with a resin composition. Illustrative examples of the base polymer of this resin composition include polyurethanes, polyesters, polyamides, polyolefins, polystyrenes and ionomer resins. In particular, a polyurethane is preferred. A polyurethane is soft. When the golf ball 2 having a cover 8 in which a polyurethane is used is hit with a short iron, a great spin rate is attained. The cover 8 constituted with a polyurethane is responsible for the control performance upon shots with a short iron. The polyurethane is also responsible for the scuff resistance performance of the cover 8.

When this golf ball 2 is hit with a driver, long iron or middle iron, the sphere composed of the core 4 and the mid layer 6 is greatly distorted due to a high head speed. Since this sphere has an outer-hard/inner-soft structure, the spin rate is suppressed. Due to suppression of the spin rate, a great flight distance is attained. When this golf ball 2 is hit with a short iron, less distortion of the sphere occurs since the head speed is low. Behavior of the golf ball 2 upon hitting with a short iron predominantly varies depending on the cover 8. Since the cover 8 containing the polyurethane is soft, a great spin rate is attained. By the great spin rate, an excellent control performance is achieved. According to this golf ball 2, flight performances achieved upon shots with a driver, a long iron and a middle iron, and control performances achieved upon shots with a short iron are both achieved with favorable balance.

When this golf ball 2 is hit, the cover 8 including a polyurethane absorbs impact. This absorption leads to a soft feel at impact achieved. In particular, when hit with a short iron or a putter, the cover 8 leads to an excellent feel at impact achieved.

Into the cover 8, the polyurethane and other resin may be used in combination. When thus used in combination, the polyurethane is included as a principal component of the base polymer in light of the spin performance and the feel at impact. The percentage of the amount of the polyurethane relative to the total amount of the base polymer is preferably no less than 50% by weight, more preferably no less than 70% by weight, and particularly preferably no less than 85% by weight.

A thermoplastic polyurethane and a thermosetting polyurethane may be used in the cover 8. In light of the productivity, a thermoplastic polyurethane is preferred. The thermoplastic polyurethane includes a polyurethane component as a hard segment, and a polyester component or a polyether component as a soft segment.

The polyurethane contains a polyol component. As the polyol, a polymer polyol is preferred. Specific examples of the polymer polyol include: polyether polyols such as polyoxyethylene glycol (PEG), polyoxypropylene glycol (PPG) and polytetramethylene ether glycol (PTMG); condensed polyester polyols such as polyethylene adipate (PEA), polybutylene adipate (PBA) and polyhexamethylene adipate (PHMA); lactone based polyester polyols such as poly-ε-caprolactone (PCL); polycarbonate polyols such as polyhexamethylene carbonate; and acrylic polyols. Two or more kinds of the polyol may be used in combination.

Particularly, a polytetramethylene ether glycol is preferred. A spin rate attained upon hitting of the golf ball 2 with a short iron has a great correlation with the content of the polytetramethylene ether glycol. On the other hand, a spin rate attained upon hitting of the golf ball 2 with a driver has a less correlation with the content of the polytetramethylene ether glycol. The golf ball 2 in which the polyurethane contains an appropriate amount of a polytetramethylene ether glycol is excellent in both terms of the flight performance achieved upon hitting with a driver, and the control performance achieved upon hitting with a short iron.

In light of the control performance, the polyol has a number average molecular weight of preferably no less than 200, more preferably no less than 400, and particularly preferably no less than 650. In light of suppression of the spin, the molecular weight is preferably no greater than 1,500, more preferably no greater than 1,200, and particularly preferably no greater than 850.

The number average molecular weight is measured with a gel permeation chromatography. The measurement conditions are as in the following.

Apparatus: HLC-8120GPC (Tosoh Corporation)
Eluent: tetrahydrofuran
Concentration: 0.2% by weight
Temperature: 40° C.
Column: TSKgel Super HM-M (Tosoh Corporation)
Amount of sample: 5 microliter
Flow rate: 0.5 ml/min
Standard substance: polystyrene (Tosoh Corporation, "PStQuick Kit-H")

Examples of the isocyanate component in the polyurethane include: aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI) and isophorone diisocyanate (IPDI); and aliphatic polyisocyanates such as hexamethylene diisocyanate (HDI). Two or more polyisocyanates may be used in combination. In light of the weather resistance, TMXDI, XDI, HDI, $H_6$XDI, IPDI and $H_{12}$MDI are preferred.

The polyurethane may contain a chain extender as a component thereof. Illustrative examples of the chain extender include low molecular weight polyols and low molecular weight polyamines.

The low molecular weight polyols are exemplified by diols, triols, tetraols and hexaols. Specific examples of the diol include ethylene glycol, diethylene glycol, propane diol, dipropylene glycol, butanediol, neopentyl glycol, pentanediol, hexanediol, heptanediol and octanediol. Specific examples of the triol include glycerin, trimethylolpropane and hexanetriol. Specific examples of the tetraol include pentaerythritol and sorbitol.

The low molecular weight polyamines are exemplified by aliphatic polyamines, monocyclic aromatic polyamines and polycyclic aromatic polyamines. Specific examples of the aliphatic polyamine include ethylene diamine, propylene diamine, butylene diamine and hexamethylene diamine. Specific examples of the monocyclic aromatic polyamine include phenylene diamine, toluene diamine, dimethyltoluene diamine, dimethylthiotoluene diamine and xylylene diamine.

The cover 8 may be molded from a composition containing a thermoplastic polyurethane and an isocyanate compound. During or following molding of the cover 8, the polyurethane is crosslinked by this isocyanate compound.

Into the cover 8 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed.

The JIS-C hardness Hc of the cover 8 is no greater than 65. By employing such a soft cover 8, a favorable control performance upon shots with a short iron can be achieved. In light of the control performance, the hardness Hc is more preferably no greater than 60, still more preferably no greater than 55, and particularly preferably no greater than 50. When the hardness is too low, the flight performance achieved upon shots with a driver may be insufficient. In this respect, the hardness is preferably no less than 20, more preferably no less than 25, and particularly preferably no less than 35. For the measurement of the hardness Hc, a slab constituted with the same resin composition as the resin composition of the cover 8 is used. The measuring method is similar to the measuring method of the hardness Hm of the mid layer 6.

The hardness Hc of the cover 8 is less than the central hardness Ho of the core 4. This golf ball 2 is excellent in the control performance achieved upon shots with a short iron. In light of the control performance, the difference (Ho−Hc) is preferably no less than 3, more preferably no less than 5, and particularly preferably no less than 8. The difference (Ho−Hc) is preferably no greater than 15.

In light of the flight performance achieved upon shots with a driver, the cover 8 has a thickness of preferably no greater than 0.8 mm, more preferably no greater than 0.6 mm, still more preferably no greater than 0.5 mm, and particularly preferably no greater than 0.4 mm. In light of the control performance achieved upon shots with a short iron, the thickness is preferably no less than 0.10 mm, and particularly preferably no less than 0.15 mm.

For forming the cover 8, a known procedure may be employed such as injection molding, compression molding or the like. Dimples 14 are formed by way of pimples formed on the cavity face of the mold when the cover 8 is molded.

In light of the feel at impact, the amount of compressive deformation Db of the golf ball 2 is preferably no less than 2.0 mm, more preferably no less than 2.1 mm, and particularly preferably no less than 2.2 mm. In light of the resilience performance, the amount of compressive deformation Db is preferably no greater than 3.5 mm, more preferably no greater than 3.0 mm, and particularly preferably no greater than 2.6 mm.

Upon measurement of the amount of compressive deformation Db, the golf ball 2 is placed on a hard plate made of metal. A cylinder made of metal gradually descends toward this golf ball 2. The golf ball 2 interposed between the bottom face of the cylinder and the hard plate is deformed. A migration distance of the cylinder, starting from the state in which an initial load of 98 N is applied to the golf ball 2 up to the state in which a final load of 1,274 N is applied thereto is measured.

The golf ball 2 may have a reinforcing layer between the mid layer 6 and the cover 8. The reinforcing layer firmly adheres to the mid layer 6, and firmly adheres also to the cover 8. Due to the reinforcing layer, detachment of the cover 8 from the mid layer 6 can be suppressed. As described above, this golf ball 2 has thin cover 8. When this golf ball 2 is hit with an edge of a clubface, a wrinkle is liable to be generated. The reinforcing layer suppresses generation of such a wrinkle.

For the base polymer of the reinforcing layer, a two-component cured thermosetting resin may be suitably used. Specific examples of the two-component cured thermosetting resin include epoxy resins, urethane resins, acrylic resins, polyester based resins and cellulose based resins. In light of the strength and durability of the reinforcing layer, two-component cured epoxy resins and two-component cured urethane resins are preferred.

The reinforcing layer may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added either to the base material of the two-component cured thermosetting resin, or to the curing agent of the two-component cured thermosetting resin.

The reinforcing layer is obtained by coating a liquid, which had been prepared by dissolving or dispersing a base material and a curing agent in a solvent, on the surface of the mid layer 6. In light of the workability, coating with a spray gun is preferred. The solvent is volatilized after the coating to permit a reaction of the base material with the curing agent, thereby forming the reinforcing layer.

In light of suppression of the wrinkle, the reinforcing layer has a thickness of preferably no less than 3 μm, and more preferably no less than 5 μm. In light of ease of forming the reinforcement layer, the thickness is preferably no greater than 300 μm, more preferably no greater than 50 μm, and particularly preferably no greater than 20 μm. The thickness is measured by observation of the cross section of the golf ball 2 with a microscope. When the surface of the mid layer 6 has roughness resulting from a surface roughening treatment, the thickness is measured immediately above the protruded portion.

In light of suppression of the wrinkle, the reinforcing layer has a pencil hardness of preferably no less than 4B, and more preferably no less than B. In light of less loss of the force during transfer from the cover 8 to the mid layer 6 upon hitting of the golf ball 2, the reinforcing layer has a pencil hardness of preferably no greater than 3H. The pencil hardness is measured in accordance with a standard of "JIS K5400".

EXAMPLES

Example 1

A rubber composition (1) was obtained by kneading 100 parts by weight of a high-cis polybutadiene ("BR-730", trade name, available from JSR Corporation), 20 parts by weight of zinc diacrylate, 5 parts by weight of zinc oxide, an adequate amount of barium sulfate, 0.5 part by weight of diphenyl disulfide and 0.7 part by weight of dicumyl peroxide. This rubber composition (1) was placed into a mold having upper and lower mold half each having a hemispherical cavity, and heated at a temperature of 170° C. for 15 minutes to obtain a center having a diameter of 15 mm.

A rubber composition (3) was obtained by kneading 100 parts by weight of a high-cis polybutadiene ("BR-730", supra), 42 parts by weight of zinc diacrylate, 5 parts by weight of zinc oxide, an adequate amount of barium sulfate, 0.5 part by weight of diphenyl disulfide and 0.7 part by weight of dicumyl peroxide. Half shells were formed from this rubber composition (3). The aforementioned center was covered by two pieces of the half shell. The center and the half shells were placed into a mold having upper and lower mold half each having a hemispherical cavity, and heated at a temperature of 170° C. for 20 min to obtain a core having a diameter of 39.7 mm. An envelope layer was formed from the rubber composition (3). The amount of barium sulfate was adjusted such that the envelope layer has a specific gravity identical to the specific gravity of the center, and the ball has a weight of 45.4 g.

A resin composition (a) was obtained by kneading 50 parts by weight of an ionomer resin ("Surlyn® 8945", supra), and 50 parts by weight of other ionomer resin ("Himilan® AM7329", supra) in a biaxial kneading extruder. The core was placed into a mold having upper and lower mold half each having a hemispherical cavity. The resin composition (a) was injected around the core by injection molding, whereby a mid layer was formed. This mid layer had a thickness of 1.0 mm.

A paint composition containing a two-component cured epoxy resin as a base polymer ("POLIN 750LE", trade name, available from Shinto Paint Co., Ltd.) was prepared. The base material liquid of this paint composition consists of 30 parts by weight of a bisphenol A type solid epoxy resin and 70 parts by weight of a solvent. The curing agent liquid of this paint composition consists of 40 parts by weight of denatured polyamide amine, 55 parts by weight of a solvent and 5 parts by weight of titanium dioxide. The weight ratio of the base material liquid and the curing agent liquid was 1/1. This paint composition was coated on the surface of the mid layer with a spray gun, and kept in an atmosphere of 40° C. for 24 hrs to give a reinforcing layer. This reinforcing layer had a thickness of 10 μm.

A resin composition (b) was obtained by kneading 100 parts by weight of a thermoplastic polyurethane elastomer ("Elastollan® XNY85A", trade name, available from BASF Japan Ltd.) and 4 parts by weight of titanium dioxide in a biaxial kneading extruder. Half shells were obtained from this resin composition (b) with compression molding. A sphere composed of the core, the mid layer and the reinforcing layer was covered by two pieces of the half shell. The sphere and half shells were placed into a final mold having upper and lower mold half each having a hemispherical cavity and being provided with a large number of pimples on the cavity face thereof. A cover was obtained by compression molding. This cover had a thickness of 0.5 mm. Dimples having a shape inverted from the shape of the pimple were formed on the cover. A clear paint including a two-component cured polyurethane as a base material was applied on this cover to give a golf ball of Example 1 having a diameter of 42.7 mm. The hardness distribution of the core of this golf ball is shown in Table 3.

Examples 2 to 8 and Comparative Examples 1 to 4

Golf balls of Examples 2 to 8, and Comparative Examples 1 to 4 were obtained in a similar manner to Example 1 except that specifications of the center, the envelope layer, the mid layer and the cover were as listed in Tables 6 to 8 below. Details of the rubber compositions of the core are presented in Table 1 below. Details of the resin compositions of the mid layer and the cover are presented in Table 2 below. The hardness distribution of the core is shown in Tables 3 to 6. The golf ball according to Comparative Example 2 does not have an envelope layer.

[Shot with Driver (W#1)]

A driver with a titanium head (SRI Sports Limited, trade name "SRIXON W505", shaft hardness: X, loft angle: 8.5°) was attached to a swing machine available from Golf Laboratory Co. Then the golf ball was hit under a condition to give the head speed of 50 m/sec. The ball speed and spin rate immediately after the hitting, and the distance from the launching point to the point where the ball stopped were measured. Mean values of the data obtained by measuring 12 times are shown in Tables 6 to 8 below.

[Shot with Short Iron]

A sand wedge (SW) was attached to a swing machine available from Golf Laboratory Co. Then the golf ball was hit under a condition to give the head speed of 21 m/sec, and the spin rate immediately after the hitting was measured. Mean values of the data obtained by measuring 12 times are shown in Tables 6 to 8 below.

[Feel at Impact]

The golf balls were hit by ten golf players with a sand wedge, and an interview was conducted on the feel at impact. Based on the number of golf players who evaluated that "the feel at impact was favorable", rating was performed according to the following criteria.

A: 8 or more

B: 6-7

C: 4-5

D: 3 or fewer

The results are shown in the following Tables 6 to 8.

TABLE 1

Composition of Core (part by weight)

| | (1) | (2) | (3) | (4) | (5) |
|---|---|---|---|---|---|
| BR-730 | 100 | 100 | 100 | 100 | 100 |
| Zinc diacrylate | 20 | 38 | 42 | 45 | 39 |
| Zinc oxide | 5 | 5 | 5 | 5 | 5 |
| Barium sulfate | * | * | * | * | * |
| Diphenyl disulfide | 0.5 | 0.5 | 0.5 | 0.5 | 0.5 |
| Dicumyl peroxide | 0.7 | 0.7 | 0.7 | 0.7 | 0.7 |

* Adequate amount

TABLE 2

Composition of Mid Layer and Cover (part by weight)

| | (a) | (b) | (c) | (d) | (e) | (f) | (g) | (h) |
|---|---|---|---|---|---|---|---|---|
| Surlyn ® 8945 | 50 | — | — | — | — | — | — | — |
| Himilan ® AM7329 | 50 | — | — | — | — | — | — | — |
| Elastollan ® XNY85A | — | 100 | — | — | — | — | — | — |
| Elastollan ® XNY90A | — | — | 100 | — | — | — | — | — |
| Elastollan ® XNY97A | — | — | — | 100 | — | — | — | — |
| Polyurethane *1 | — | — | — | — | 100 | — | — | — |
| Polyurethane *2 | — | — | — | — | — | 100 | — | — |
| Polyurethane *3 | — | — | — | — | — | — | 100 | — |
| Polyurethane *4 | — | — | — | — | — | — | — | 100 |
| Titanium dioxide | — | 4 | 4 | 4 | 4 | 4 | 4 | 4 |
| Hardness (JIS-C) | 94 | 47 | 56 | 67 | 45 | 42 | 42 | 38 |
| Hardness (Shore D) | 64 | 32 | 38 | 47 | 30 | 28 | 28 | 25 |

Any of Elastollan® XNY85A, Elastollan® XNY90A, Elastollan® XNY97A, polyurethane *1, polyurethane *2, polyurethane *3 and polyurethane *4 is a thermoplastic polyurethane elastomer including a polytetramethylene ether glycol as a polyol component. The number average molecular weight of the polytetramethylene ether glycol is as in the following.

Elastollan® XNY85A: 1,800

Elastollan® XNY90A: 1,800

Elastollan® XNY97A: 1,800 polyurethane *1: 1,500 polyurethane *2: 1,000 polyurethane *3: 850 polyurethane *4: 650

TABLE 3

Hardness Distribution of Core (JIS-C)

| Distance from the central point (mm) | Example 1 | Example 2 | Example 3 | Example 4 |
|---|---|---|---|---|
| 0 | 60 | 60 | 60 | 60 |
| 1.0 | 61 | 60.8 | 61 | 61 |
| 2.0 | 62 | 61.6 | 62 | 62 |
| 3.0 | 63 | 62.4 | 63 | 63 |
| 4.0 | 64 | 63.2 | 64 | 64 |
| 5.0 | 65 | 64 | 65 | 65 |
| 6.0 | 66 | 65 | 66 | 66 |
| 7.0 | 67 | 66 | 66 | 67 |
| 8.0 | 75 | 67 | 75 | 75 |
| 9.0 | 76 | — | 76 | 76 |
| 10.0 | 77 | 77 | 77 | 77 |
| 11.0 | 78 | 78 | 78 | 78 |

TABLE 4

Hardness Distribution of Core (JIS-C)

| Distance from the central point (mm) | Example 5 | Example 6 | Example 7 |
|---|---|---|---|
| 0 | 60 | 60 | 60 |
| 1.0 | 61 | 61 | 61 |
| 2.0 | 62 | 62 | 62 |

TABLE 4-continued

| Hardness Distribution of Core (JIS-C) | | | |
|---|---|---|---|
| Distance from the central point (mm) | Example 5 | Example 6 | Example 7 |
| 3.0 | 63 | 63 | 63 |
| 4.0 | 64 | 64 | 64 |
| 5.0 | 65 | 65 | 65 |
| 6.0 | 66 | 66 | 66 |
| 7.0 | 67 | 67 | 67 |
| 8.0 | 75 | 75 | 75 |
| 9.0 | 76 | 76 | 76 |
| 10.0 | 77 | 77 | 77 |
| 11.0 | 78 | 78 | 78 |

TABLE 5

| Hardness Distribution of Core (JIS-C) | | | | |
|---|---|---|---|---|
| Distance from the central point (mm) | Compara. Example 1 | Compara. Example 2 | Compara. Example 3 | Compara. Example 4 |
| 0 | 60 | 70 | 60 | 60 |
| 1.0 | 61 | 71.2 | 60.9 | 61 |
| 2.0 | 62 | 72.4 | 61.8 | 62 |
| 3.0 | 63 | 73.6 | 62.7 | 63 |
| 4.0 | 64 | 74.8 | 63.6 | 64 |
| 5.0 | 65 | 76 | 64.5 | 65 |
| 6.0 | 66 | 76 | 65.4 | 65.5 |
| 7.0 | 67 | 76 | 66.3 | 66 |
| 8.0 | 75 | 76 | 67.2 | 73 |
| 9.0 | 76 | 76 | 68.1 | 74 |
| 10.0 | 77 | 76 | 69 | 75 |
| 11.0 | 78 | 77 | 70 | 76 |

TABLE 6

| Evaluation Results | | | | | |
|---|---|---|---|---|---|
| | | Example 1 | Exampl 2 | Example 3 | Example 4 |
| Center | Composition | (1) | (1) | (1) | (1) |
| | Crosslinking temperature (° C.) | 170 | 170 | 170 | 170 |
| | Crosslinking time (min) | 15 | 15 | 15 | 15 |
| | Diameter (mm) | 15 | 18 | 15 | 15 |
| Envelope layer | Composition | (3) | (3) | (3) | (3) |
| | Crosslinking temperature (° C.) | 170 | 170 | 170 | 170 |
| | Crosslinking time (min) | 20 | 20 | 20 | 20 |
| Core | Diameter (mm) | 39.7 | 40.1 | 40.3 | 39.7 |
| | Volume proportion (%) | 80.4 | 82.8 | 84.1 | 80.4 |
| | Hardness Ho (JIS-C) | 60 | 60 | 60 | 60 |
| | Hardness He (JIS-C) | 88 | 88 | 88 | 88 |
| Mid layer | Composition | (a) | (a) | (a) | (a) |
| | Hardness (JIS-C) | 94 | 94 | 94 | 94 |
| | Thickness (mm) | 1.0 | 1.0 | 0.9 | 1.0 |
| Cover | Composition | (b) | (c) | (e) | (e) |
| | Hardness (JIS-C) | 47 | 56 | 45 | 45 |
| | Thickness (mm) | 0.5 | 0.3 | 0.3 | 0.5 |
| Ball | Deformation Db (mm) | 2.40 | 2.45 | 2.40 | 2.40 |
| Ha2 − Ha1 (maximum value) | | 2 | 1.6 | 2 | 2 |
| Hb2 − Hb1 (maximum value) | | 9 | 10 | 10 | 9 |
| W #1 | Ball speed (m/s) | 73.9 | 74.0 | 74.1 | 73.9 |
| | Spin (rpm) | 2,440 | 2,310 | 2,410 | 2,370 |
| | Flight distance (m) | 248.5 | 251.0 | 250.0 | 249.5 |
| SW | Spin (rpm) | 6,720 | 6,530 | 6,690 | 6,710 |
| Feel at impact | | A | B | A | A |

TABLE 7

| Evaluation Results | | | | |
|---|---|---|---|---|
| | | Example 5 | Example 6 | Example 7 |
| Center | Composition | (1) | (1) | (1) |
| | Crosslinking temperature (° C.) | 170 | 170 | 170 |
| | Crosslinking time (min) | 15 | 15 | 15 |
| | Diameter (mm) | 15 | 15 | 15 |
| Envelope layer | Composition | (3) | (3) | (3) |
| | Crosslinking temperature (° C.) | 170 | 170 | 170 |
| | Crosslinking time (min) | 20 | 20 | 20 |
| Core | Diameter (mm) | 39.7 | 39.7 | 39.7 |
| | Volume proportion (%) | 80.4 | 80.4 | 80.4 |
| | Hardness Ho (JIS-C) | 60 | 60 | 60 |
| | Hardness He (JIS-C) | 88 | 88 | 88 |
| Mid layer | Composition | (a) | (a) | (a) |
| | Hardness (JIS-C) | 94 | 94 | 94 |
| | Thickness (mm) | 1.0 | 1.0 | 1.0 |
| Cover | Composition | (f) | (g) | (h) |
| | Hardness (JIS-C) | 42 | 42 | 38 |
| | Thickness (mm) | 0.5 | 0.5 | 0.5 |
| Ball | Deformation Db (mm) | 2.40 | 2.40 | 2.40 |
| Ha2 − Ha1 (maximum value) | | 2 | 2 | 2 |
| Hb2 − Hb1 (maximum value) | | 9 | 9 | 9 |
| W #1 | Ball speed (m/s) | 73.9 | 73.9 | 73.9 |
| | Spin (rpm) | 2,350 | 2,320 | 2,370 |
| | Flight distance (m) | 250.0 | 250.5 | 249.5 |
| SW | Spin (rpm) | 6,690 | 6,640 | 6,770 |
| Feel at impact | | A | A | A |

TABLE 8

| Evaluation Results | | | | | |
|---|---|---|---|---|---|
| | | Compa. Example 1 | Compa. Example 2 | Compa. Example 3 | Compa. Example 4 |
| Center | Composition | (1) | (2) | (1) | (1) |
| | Crosslinking temperature (° C.) | 170 | 170 | 170 | 170 |
| | Crosslinking time (min) | 15 | 20 | 15 | 15 |
| | Diameter (mm) | 15 | 39.7 | 25 | 15 |
| Envelope layer | Composition | (3) | — | (4) | (5) |
| | Crosslinking temperature (° C.) | 170 | — | 170 | 170 |
| | Crosslinking time (min) | 20 | — | 20 | 20 |
| Core | Diameter (mm) | 39.7 | 39.7 | 39.1 | 38.5 |
| | Volume proportion (%) | 80.4 | 80.4 | 76.8 | 73.3 |
| | Hardness Ho (JIS-C) | 60 | 70 | 60 | 60 |
| | Hardness He (JIS-C) | 88 | 86 | 90 | 86 |
| Mid layer | Composition | (a) | (a) | (a) | (a) |
| | Hardness (JIS-C) | 94 | 94 | 94 | 94 |
| | Thickness (mm) | 1.0 | 1.0 | 1.0 | 1.6 |
| Cover | Composition | (d) | (b) | (b) | (b) |
| | Hardness (JIS-C) | 67 | 47 | 47 | 47 |
| | Thickness (mm) | 0.5 | 0.5 | 0.8 | 0.5 |
| Ball | Deformation Db (mm) | 2.40 | 2.40 | 2.40 | 2.40 |
| Ha2 − Ha1 (maximum value) | | 2 | 2.4 | 1.8 | 2 |
| Hb2 − Hb1 (maximum value) | | 9 | 1 | 1.9 | 8 |
| W #1 | Ball speed (m/s) | 74.0 | 74.0 | 73.5 | 73.6 |
| | Spin (rpm) | 2,270 | 2,580 | 2,360 | 2,420 |
| | Flight distance (m) | 251.5 | 247.0 | 246.0 | 247.0 |
| SW | Spin (rpm) | 6,400 | 6,750 | 6,670 | 6,610 |
| Feel at impact | | B | A | A | B |

As is shown in Tables 6 to 8, the golf balls according to Examples are excellent in various performances. Therefore, advantages of the present invention are clearly suggested by these results of evaluation.

The golf ball according to the present invention can be used for the play at the golf course, and the practice at the driving range. The foregoing description is just for illustrative examples; therefore, various modifications can be made in the scope without departing from the principles of the present invention.

What is claimed is:

1. A golf ball comprising a core, a mid layer situated on the external side of the core, and a cover situated on the external side of the mid layer, wherein:

said core comprises a zone "A" away from the central point of the core at a distance of 1 mm or greater and less than 5 mm and said core comprises a zone "B" away from the central point of the core at a distance of 5 mm or greater and 10 mm or less, the proportion of the volume of the core relative to the volume of the phantom sphere of the golf ball is no less than 76%;

the JIS-C hardness Hc of the cover is less than the JIS-C hardness Ho of the central point of the core;

at all points Pa included in said zone "A", the following mathematical expression (I) is satisfied:

$$Ha2-Ha1<5 \quad \text{(I)},$$

wherein Ha1 represents a JIS-C hardness at a point Pa1 that is located inside the point Pa along the radial direction and away from the point Pa at a distance of 1 mm, and Ha2 represents the JIS-C hardness at a point Pa2 that is located outside the point Pa along the radial direction and away from the point Pa at a distance of 1 mm; and at any point Pb included in said zone "B", the following mathematical expression (II) is satisfied:

$$Hb2-Hb1\geq 5 \quad \text{(II)},$$

wherein Hb1 represents the JIS-C hardness at a point Pb1 that is located inside the point Pb along the radial direction and away from the point Pb at a distance of 1 mm, and Hb2 represents a JIS-C hardness at a point Pb2 that is located outside the point Pb along the radial direction and away from the point Pb at a distance of 1 mm.

2. The golf ball according to claim 1, wherein the JIS-C hardness Hc of the cover is no greater than 65.

3. The golf ball according to claim 1, wherein the cover has a thickness of no greater than 0.8 mm.

4. The golf ball according to claim 1, wherein: a principal component of the base material of the cover is a thermoplastic polyurethane; and a polyol component of the thermoplastic polyurethane is a polytetramethylene ether glycol having a number average molecular weight of no greater than 1,500.

5. The golf ball according to claim 1, wherein the JIS-C hardness Hm of the mid layer is no less than 90.

6. The golf ball according to claim 1, wherein the mid layer has a thickness of no greater than 1.5 mm.

7. The golf ball according to claim 1, wherein the difference between the JIS-C hardness He of the surface of the core and the hardness Hb2 is no less than 10.

8. The golf ball according to claim 1, wherein the difference between the JIS-C hardness He of the surface of the core and the hardness Ho is no greater than 40.

9. The golf ball according to claim 1, wherein the difference between the hardness Ho and the hardness Hc is 3 or greater and 15 or less.

10. The golf ball according to claim 1, wherein the hardness Ho is 40 or greater and 80 or less.

11. The golf ball according to claim 1, wherein the JIS-C hardness He of the surface of the core is 75 or greater and 95 or less.

12. The golf ball according to claim 1, wherein the JIS-C hardness Hm of the mid layer is greater than the JIS-C hardness He of the surface of the core.

13. The golf ball according to claim 1, wherein the core has a center, and an envelope layer situated on the external side of the center.

14. The golf ball according to claim 13, wherein the center has a diameter of 10 mm or greater and 20 mm or less.

15. The golf ball according to claim 13, wherein the envelope layer has a thickness of 8 mm or greater and 18 mm or less.

16. The golf ball according to claim 13, wherein the difference between the JIS-C hardness He of the surface of the envelope layer and the JIS-C hardness Hi of the innermost point of the envelope layer is 10 or greater and 25 or less.

17. The golf ball according to claim 13, wherein the JIS-C hardness He of the surface of the core is greater than the JIS-C hardness of the surface of the center.

* * * * *